US009277778B1

(12) United States Patent
Fulper et al.

(10) Patent No.: US 9,277,778 B1
(45) Date of Patent: Mar. 8, 2016

(54) ERGONOMIC HEADWEAR SYSTEMS AND APPARATUSES FOR REDUCING LIGHT EXPOSURE

(71) Applicants: Norman Peter Robert Fulper, Gretna, VA (US); Norman Bennett Fulper, Gretna, VA (US)

(72) Inventors: Norman Peter Robert Fulper, Gretna, VA (US); Norman Bennett Fulper, Gretna, VA (US)

( * ) Notice: Subject to any disclaimer, the term of this patent is extended or adjusted under 35 U.S.C. 154(b) by 0 days.

(21) Appl. No.: 14/835,321

(22) Filed: Aug. 25, 2015

(51) Int. Cl.
*A42B 1/06* (2006.01)
*A42B 1/22* (2006.01)

(52) U.S. Cl.
CPC ..... *A42B 1/064* (2013.01); *A42B 1/066* (2013.01); *A42B 1/22* (2013.01)

(58) Field of Classification Search
CPC ..... A42B 1/066; A42B 1/22; A42B 1/067; A42B 3/227; A42B 1/004; A42B 1/02; A42B 1/062; A42B 1/068; A42B 1/12; A42B 3/14; A42B 7/00; A42C 5/00; A42C 5/02; A63B 21/4003; A63B 23/025
USPC ..... 2/172, 175.1, 181, 183, 209.13, 175.3, 2/10, 171, 181.4, 195.1, 209.11, 209.12, 2/DIG. 11, 175.2, 175.5, 182.1, 195.2, 2/195.7, 203, 207, 209, 209.3, 272, 410, 2/417, 418, 421, 423, 5, 68
See application file for complete search history.

(56) References Cited

U.S. PATENT DOCUMENTS

| | | | | | |
|---|---|---|---|---|---|
| 191,061 | A * | 5/1877 | Kuhlman | A41D 27/06 | 2/182.1 |
| 240,351 | A * | 4/1881 | Adams | A42B 1/066 | 2/172 |
| 276,753 | A * | 5/1883 | Bartine | A42B 1/201 | 2/171.03 |
| 591,311 | A * | 10/1897 | Watson et al. | A42B 1/004 | 2/171.02 |
| 1,081,333 | A * | 12/1913 | Reese | A42B 1/066 | 2/172 |
| 1,187,507 | A * | 6/1916 | Coyne | A42B 1/201 | 2/171.03 |
| 1,364,669 | A * | 1/1921 | Winch | A42B 1/066 | 2/172 |
| 1,441,180 | A * | 1/1923 | Gwilym | A42B 1/12 | 2/175.5 |
| 1,997,678 | A * | 4/1935 | Cremen | A42B 1/22 | 2/183 |
| 2,055,560 | A * | 9/1936 | Rose | A42B 1/067 | 2/172 |
| 2,192,341 | A * | 3/1940 | Dahlberg | A42B 1/067 | 2/172 |
| 2,880,423 | A * | 4/1959 | O'Reilly | A42B 1/02 | 2/171.01 |

(Continued)

*Primary Examiner* — Bobby Muromoto, Jr.
(74) *Attorney, Agent, or Firm* — Ryan Alley Intellectual Property Law

(57) ABSTRACT

Headwear reduces radiation exposure with a brim on a top crown that generally surrounds the head. The brim is above a bottom of the crown to avoid interfering with the ears, face, and/or adjustment strap of the cap, which may be of critical importance for those needing protection from sunlight. Brims are positionable a half-inch or more above the bottom of the crown and may completely or partially extend about the crown. Brims may extend at an angle of 20-degrees or more to provide clearance for the ears, face, and any adjustment structure. Brims may be integral with or nondestructively removable from the crown and may include bands or cut-outs for existing brims, bills, or adjustment structures for fitting of hats to which removable brims are added. Headwear may be rigid or a flexible canvas.

16 Claims, 4 Drawing Sheets

(56) References Cited

U.S. PATENT DOCUMENTS 4,114,201 A * 9/1978 Garrison ..... A42C 5/04 2/209.7
4,272,853 A * 6/1981 Schuessler ..... A42B 3/105 2/205
5,121,508 A * 6/1992 Grilliot ..... A42B 3/14 2/421
5,351,343 A * 10/1994 Harbison ..... A42B 1/068 2/172
5,381,559 A * 1/1995 Wakefield, III ..... A42B 1/241 2/172
5,649,327 A * 7/1997 Crewe ..... A42B 1/067 2/172
5,727,250 A * 3/1998 Black ..... A42B 3/227 2/10
5,862,520 A * 1/1999 Wyant ..... A42B 1/02 2/10
5,996,125 A * 12/1999 Garzone ..... A42B 3/227 2/10
6,151,712 A * 11/2000 Lampi ..... A42B 1/02 2/10
6,539,553 B2 * 4/2003 Day ..... A42B 1/004 2/175.1
6,748,606 B1 * 6/2004 Silverstein ..... A42B 1/22 2/181.4
7,082,620 B1 * 8/2006 Rongione ..... A42C 5/02 2/175.1
8,402,564 B2 * 3/2013 Duwyn-Zylstra ..... A42B 1/22 2/175.1
2004/0163162 A1 * 8/2004 Benziger ..... A42B 1/08 2/411
2004/0244094 A1 * 12/2004 Ahn ..... A42B 1/064 2/175.3
2006/0048274 A1 * 3/2006 Lee ..... A42B 1/062 2/181
2008/0060117 A1 * 3/2008 Timms ..... A42B 1/08 2/171
2009/0064394 A1 * 3/2009 White ..... A42B 1/22 2/183
2012/0054936 A1 * 3/2012 Cornell ..... A42B 3/227 2/9
2012/0210491 A1 * 8/2012 Bryan ..... A42B 3/227 2/181.4
2013/0047323 A1 * 2/2013 Ireland ..... A42B 3/003 2/422

* cited by examiner

ERGONOMIC HEADWEAR SYSTEMS AND APPARATUSES FOR REDUCING LIGHT EXPOSURE

BACKGROUND

Sports caps typically include with a crown portion that covers the head and a bill extending outwardly from the crown to shield the wearer from sunlight or other bright light. The bill extends from a lowest point or bottom of the crown, typically about 90-180 degrees about only a portion of the crown, to provide the shielding function while not obstructing peripheral vision, or, if rotated about the head so that the bill is in back, to allow complete vision with no shielding of the face. The bill is typically semi-rigid, with layers of heavy fabric or cardboard insert to generally maintain shape with some flexibility. Existing sports caps may be fitted or include an elastic portion for improved fit or and/or may include a headband adjustment mechanism to achieve proper fit, including snapbacks, strap-and-clasps, ties, Velcro straps, etc. Sports caps often include signage or branding on the crown and/or bill, sometimes on a specially-vertical display portion of the crown, below which the bill extends.

Wide brim hats, on the other hand, are conventionally more bulky with a brim that extends from a bottom of the crown about 360 degrees, or the entire crown. The brim provides complete sun/light protection about the crown so as to shade the face, ears, and back of head/neck. Whereas a sports cap brim is typically semi-rigid, a wide-brimmed hat typically includes a flexible brim, such as a canvas brim. Wide brim hats may include an adjustment element for fit; however, because positioning is less important with the full brim, both conventional sports caps and wide-brimmed hats are sized and fitted such that the crown terminates vertically at mid-brow of a wearer. In the case of a sports cap, that the crown rests on a portion of the top of the ear joining the scalp, and the bill extends from this vertical bottom.

SUMMARY

Example embodiments include apparatuses that providing ergonomic headwear that reduces radiation exposure. Example apparatuses include or are useable with caps that have a top crown that generally surrounds the head, and example apparatuses include an extension, like a brim, from the top crown. Extensions in example embodiments are above a bottom vertical portion of the crown; that is, the crown extends vertically below the brim so the brim blocks or reflects ultraviolet radiation without interfering with the ears, face, and/or adjustment strap of the cap. For example, the brim may be positioned an inch or more vertically above the bottom of the sides and back of the crown. Example apparatuses may provide brims that completely or partially pass around a perimeter of the crown, and such brims may be opaque and extend several inches to provide desired shading. Such brims may extend at an angle, such as 20-degrees or more, with respect to the vertical, so as to provide clearance for the ears and any adjustment structure. Example apparatuses may include integral brims that are irremovably joined to the crown or removable brims that are joined to the brim by releasable structures. Removable brims may include bands or cut-outs to accommodate existing brims, bills, or adjustment structures for fitting of hats to which the removable brims are added. Such removable brims may have an inner perimeter smaller than an outer perimeter of the cap's crown to achieve desired higher positioning. Example apparatuses may be rigid or flexible, such as a mesh or canvas.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION

Figure 1:
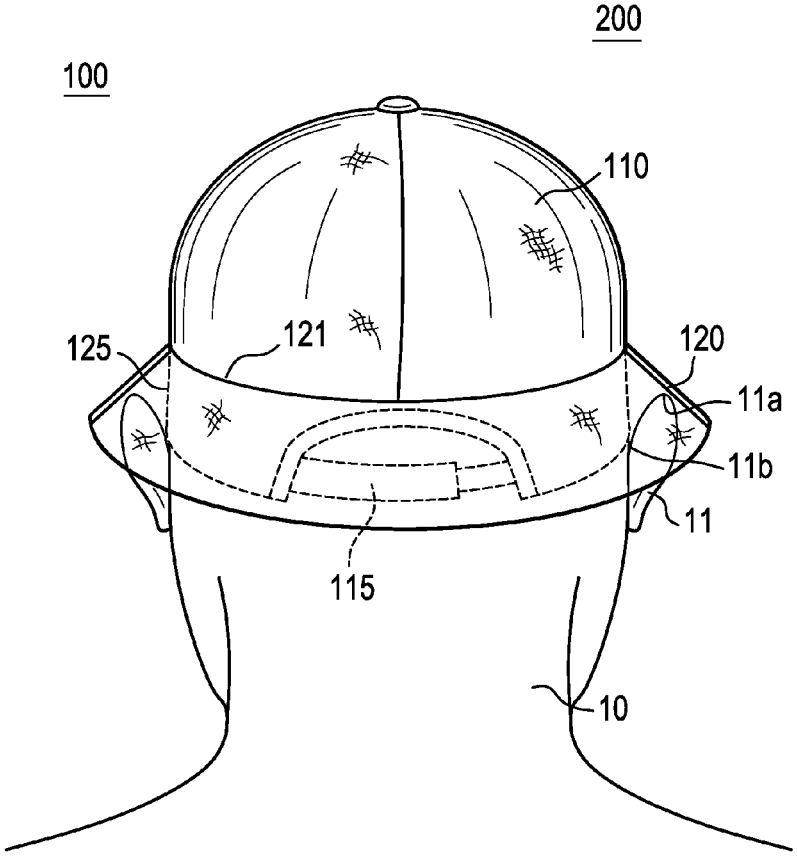
FIG. 1 is an illustration of an example embodiment headgear apparatus

Because this is a patent document, general broad rules of construction should be applied when reading it. Everything described and shown in this document is an example of subject matter falling within the scope of the claims, appended below. Any specific structural and functional details disclosed herein are merely for purposes of describing how to make and use example embodiments. Several different embodiments not specifically disclosed herein may fall within the claim scope; as such, the claims may be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, "and" and "or" are equivalent to the term "and/or," which includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). Similarly, a term such as "communicatively connected" includes all variations of information exchange routes between two devices, including intermediary devices, networks, etc., connected wirelessly or not.

As used herein, the singular forms "a", "an" and "the" and the plural form "indicia" are intended to include both the singular and plural forms, unless the language explicitly indicates otherwise. It will be further understood that the terms "comprises," "comprising," "includes," and/or "including," when used herein, specify the presence of stated features, integers, steps, operations, elements, and/or components, but do not themselves preclude the presence or addition of one or more other features, integers, steps, operations, elements, components, and/or groups thereof.

It should also be noted that the structures and operations discussed below may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, so as to provide looping or other series of operations aside from the single operations described below. It should be presumed that any embodiment having features and functionality described below, in any workable combination, falls within the scope of example embodiments.

The inventor has recognized that existing hats whose primary purpose is shade often poorly interact with the physiognomies of those most likely to desire shading apparel. Specifically, a common form of cancer in the US—melanoma—is very likely to occur on upper portions of the ear and brow, due to increased ultraviolet exposure of those areas. Melanoma treatment often includes surgical and chemical applications directly to the skin, resulting in areas that are sensitive or should not be touched. As such, patients often avoid clothing or headgear that will directly rest on, or rub against, treatment sites. Yet patients presenting with melanoma are often advised to strictly avoid additional ultraviolet exposure. As such, the inventors have recognized that it is often skin cancer sufferers who would like to both achieve sun/light blocking to the upper face and ears with a wide-brimmed hat but are unable to do so because the brims extend directly against the ear and/or will rub the ear, where melanoma treatment is very likely. More generally, the inventor has recognized that prevention is even preferable to treatment, and a wide-brim hat that does not touch the ears would be more comfortable, thus encouraging preventative measures in the first place.

To overcome these newly-recognized problems as well as others, the inventor has developed apparatuses that shade wearers from sun and/or other ultraviolet radiation sources, particularly about the ear and brow, without contacting or rubbing potentially sensitive areas, all while permitting customizable adjustment of such apparatuses.

FIG. 1 is an illustration of an example embodiment headgear apparatus 100. As shown in FIG. 1, headgear apparatus 100 includes a crown 110 that generally covers the head of a human 10. Crown 110 may fit snuggly about head of wearer 10, with a bottom portion 125 that extends down to or near the dorsal attachment of the outer ear to the scalp 11*b* and medial to the upper ear 11*a*. Bottom portion 125 may be fitted to the head of wearer 10 and/or may include an adjustment structure 115, such as an adjustable snap, Velcro, ratchet, tie, and/or elastic band to allow crown to surround and seat on the head of wearer 10. Crown 110 may be hard or soft and may be fabricated of any material, including a plastic solid or mesh material, fabric, or canvas that substantially blocks ultraviolet transmission. Crown 110 may further include ventilation holes, waterproofing, and additional headgear attachments.

As seen in FIG. 1, apparatus 100 includes a brim 120 that extends outward from crown 110 laterally and away from a head of user 10. For example, brim 120 may be at a 45-degree angle with a vertical of crown 110. Brim 120 may similarly be hard or soft, like crown 110, and fabricated of a shading material, like an opaque canvas, leather, or plastic. Brim 120 may extend completely or partially about a circumference of crown 110.

As seen in FIG. 1, brim 121 meets crown 110 above lower portion 125 of crown 110, such lower portion 125 being where crown 110 may rest on or nearly on dorsal connection 11*b* against the head medial to the upper ear 11*a*. For example, brim 121 may meet crown 110 a half-inch, one inch, or more above a bottom of crown 110, such that brim 120 is positioned well above ears 11. While brim 121 is above a lower portion 125 of crown 110, the exact distance may be varied based on length and angle of brim 121. For example, if brim 120 is at a nearly 90-degree angle with respect to a vertical of crown 110, brim 120 may be only 2 or more inches in length (or width, as determined from an extension from a side of crown 110) and placed lower on crown 110 but not interfere with ears 11. Or, for example, if brim 120 is at a lesser angle, such as 20-degrees with respect to a vertical of crown 110, brim 120 may be three or more inches in length (or width, as determined from an extension from a side of crown 110) and placed several inches above lower portion 125 where crown 110 rests on or nearly on ears at connection 11*b* so as to avoid ears 11. Other sizings and locations are possible, such that brim 120 provides shading functionality without touching ears 11 or other parts of a human wearer 10.

Brim 120 may be attached to, or meet crown 110 about, an inner edge 121 of brim 120. Inner edge 121 is positioned and/or sized such that brim 120 remains above and away from ears or a face of wearer 10 while apparatus 100 is worn on the head. Inner edge 121 may also be positioned above adjustment structure 115, permitting user interaction with adjustment structure 115 without interference from brim 120. In this way, example embodiment headgear apparatus 100 can be adjusted, fitted, or sat upon a head of user 10 through head contact of crown 110 and/or lower portion 125 crown fitting to or resting on or nearly on ears at point 11*b*, without interference from brim 120 that will otherwise function to block sunlight or other ultraviolet light sources.

Brim 120 may be nondestructively removable from crown 110. Or brim 120 may be integrally affixed with crown 110. For example, brim 120 may simply abut crown 110 and rest above lower portion 125 by virtue of friction and sizing of inner edge 121. Or brim 120 may include several snaps, a zipper, Velcro, magnetics, latches, adhesives, ties, and/or any other attaching structure that corresponds with attaching structures on crown 110 in order to removably affix the two at desired positions. Still further, brim 120 may be sewn to, molded with, locked into, or otherwise irremovably joined to crown 110. All these example types of attachments between brim 120 and crown 110 are positioned to permit brim 120 to meet crown 110 above lower portion 125 so as to avoid ears 11, adjustment mechanism 115, and/or facial extremities while shading the same.

Figure 2:
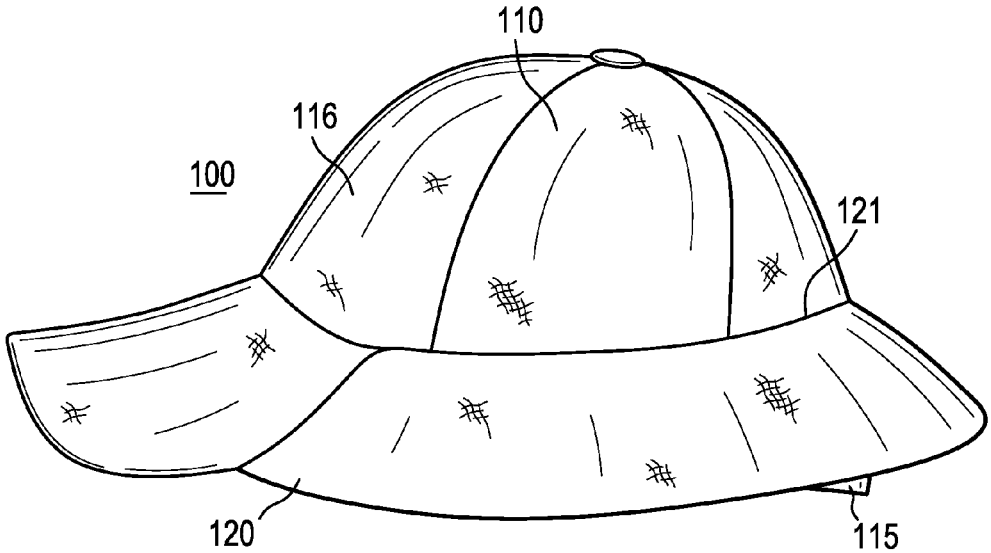
FIG. 2 is a side illustration of the apparatus of FIG. 1.

FIG. 2 is a side illustration of example embodiment headgear apparatus 100, illustrating several similar features described in connection with FIG. 1. As seen in FIG. 1, brim 120 can be uniform or varied. For example, brim 120 may have a longer, baseball cap extension in the front to better cover the face. Apparatus 100 may also include a signage area 116 on a front or other portion of crown 110. Signage area 116 may be relatively flat and/or vertically upright in order to display a name, logo, phrase, or other visual element.

Figure 3:
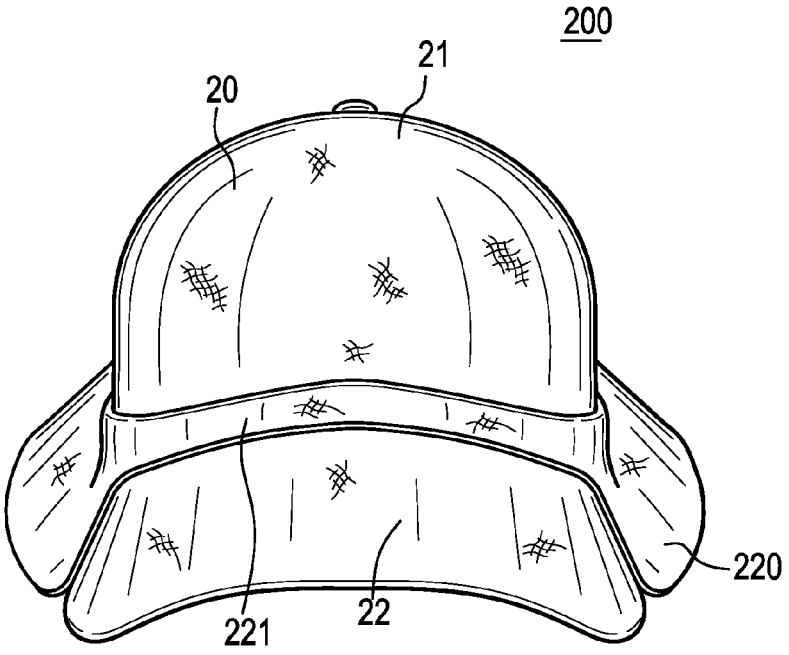
FIG. 3 is an illustration of another example embodiment headgear system.

FIG. 3 is an illustration of another example embodiment headgear system 200. As shown in FIG. 3, an existing or conventional baseball cap 20 with crown 21 and front brim 22 may be outfitted with an additional, higher shade brim 220. For example, shade brim 220 may effectively convert a baseball cap 20 into a structure like example embodiment headgear apparatus 100 (FIGS. 1 & 2) by placing shade brim 220 on cap 20. As seen in FIG. 3, brim 220 may be complete or partial, with a cut-out for an existing brim 22. Brim 220 may rest on cap 21 via an upper band 221.

In order to preserve desired height and shade—so as to prevent interaction with a user's ears or facial extremities—upper band 221 is sized and/or positioned to meet crown 21 of cap 20 at a vertically higher point. For example, upper band 221 may be sized smaller than crown 20 so as to intersect and rest on the same at a point above a lower edge or portion of crown 20. Or, for example, upper band 221 may include elastic or an adjustable snap, latch, ratchet, etc. in order to adjust in size to achieve such higher intersection. To further secure brim 220 and cap 20, brim 220 may include elastic or removable fasteners such as buttons, snaps, straps, magnetic members, Velcro, etc. that correspond to fasteners on cap 20 to secure cap 20 and brim 220 together. Similarly, upper band 221 may be irremovably joined to cap 20 through stitching, gluing, or integral formation, for example.

Figure 4:
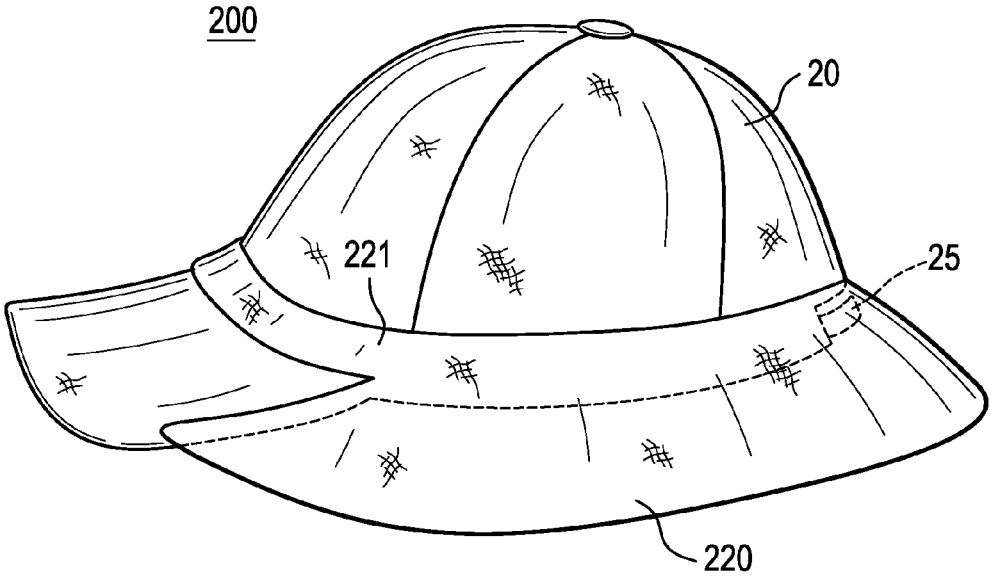
FIG. 4 is a side illustration of the system of FIG. 3

FIG. 4 is a side view of example embodiment headgear system 200 showing positioning of brim 220 well above a lower portion and any adjustment structure 25 of cap 20. Through proper sizing and joining, brim 220 may be positioned above, and not interfere with, existing adjustment structure 25 as well as ears or face of a user wearing system 200. Brim 220, however, still provides ample ultraviolet radiation blockage by its size and angle of extension from cap 20. Brim 220 may be fabricated of any material that provides desired ultraviolet radiation blocking, including rigid and flexible materials and/or those materials matching cap 20.

Some example embodiments being described here, it is understood that one or more examples and components thereof may be used in combination and/or in duplication to provide desired non-interfering head shade. It will further be appreciated by one skilled in the art that example embodiments may be varied through routine experimentation and without further inventive activity. For example, although some examples rely on a single headgear structure to achieve desired shade, it is understood that other examples may use several separate pieces, including separate cap and brims, as well as multi-part or plural brims. Variations are not to be regarded as departure from the spirit and scope of the exemplary embodiments, and all such modifications as would be obvious to one skilled in the art are intended to be included within the scope of the following claims.

What is claimed is:

1. An apparatus for providing comfortable radiation shading, the apparatus comprising:

a crown shaped to cover a human head, wherein the crown includes an adjuster for tightening or loosening the crown about the human head; and a brim extending outward from the crown, wherein the crown extends vertically below the brim so that the brim is elevated above a bottom of the apparatus, and wherein the brim blocks or reflects ultraviolet radiation, wherein the brim meets the crown at a position vertically above the adjuster so as to not touch the adjuster.

2. The apparatus of claim 1, wherein the crown extends over one half-inch directly vertically below the brim at sides and a back of the crown such that the brim is positioned apart from ears on the human head when the apparatus is worn.

3. The apparatus of claim 2, wherein the brim extends completely around a perimeter of the crown, and wherein the brim extends outward from the crown by at least two inches.

4. The apparatus of claim 3, wherein the brim is removably attached to the crown.

5. The apparatus of claim 4, wherein the brim has an inner perimeter smaller than an outer perimeter of the crown so that the brim meets the crown over one inch above the bottom.

6. The apparatus of claim 1, wherein the brim is fabricated of opaque canvas.

7. The apparatus of claim 1, wherein the brim directly touches the crown continuously about a continuous inner edge of the brim, and wherein the inner edge intercepts at least one-half inch vertically above a bottom vertical edge of the crown, and wherein the crown is shaped such that the bottom vertical edge of the crown rests on or nearly on a portion where ears connect to the human head.

8. The apparatus of claim 7, wherein the brim is flexible and opaque to visible and ultraviolet light.

9. The apparatus of claim 8, wherein the brim is integrally joined to the crown so as to be irremovable without destruction, wherein the crown includes an adjuster configured to fit the crown to the human head.

10. The apparatus of claim 8, wherein the brim extends at an angle with respect to the crown at sides and a back bottom of the crown, and wherein the angle is greater than 20 degrees.

11. An apparatus for providing comfortable radiation shading, the apparatus comprising:

a crown shaped to cover a human head, wherein the crown includes an adjuster for tightening or loosening the crown about the human head;

a brim having an inner perimeter shaped to seat on the crown worn on a human head so that the brim extends outward from the crown and the crown extends vertically below the brim, wherein the brim blocks or reflects ultraviolet radiation, and wherein the brim is shaped to seat on the crown at a position vertically above the adjuster so as to not touch the adjuster; and a band configured to lay on a bill of the hat, wherein the band connects at both ends to the brim.

12. The apparatus of claim 11, wherein the brim is opaque, flexible, and over two inches in width.

13. The apparatus of claim 12, wherein the brim and the band are non-destructively removable from the crown, wherein the band has a lesser width than the brim, and wherein the band and the brim completely surround the hat.

14. The apparatus of claim 13, wherein the brim and the band are sized and shaped to seat the brim on the hat over one inch above a vertical bottom of the hat so as to avoid ears of a wearer of the hat and an adjuster of the hat.

15. Headwear providing interference-free shade to a human wearer, the headwear comprising:

a crown shaped to cover a head of the wearer, wherein the crown includes, an adjuster configured to tighten the crown about the head of the wearer when worn, a front positioned above a face of the wearer when worn, two sides each positioned vertically above and extending horizontally behind a unique ear of the wearer when worn, and a back positioned above a nape of a neck of the wearer when worn; and a brim directly touching and extending horizontally outward from the crown continuously about at least the sides and the back of the crown, wherein the crown extends vertically below the brim where the brim touches the crown at the two sides so that the brim does not touch either unique ear when worn, wherein the crown extends vertically below the brim where the brim touches the crown at the back so that the brim does not touch the adjuster, and wherein the brim, blocks or reflects substantially all visible and ultraviolet radiation, is flexible, and is over two inches in length as measured from wherein the brim touches the crown to a horizontal edge of the brim.

16. The headwear of claim 15, wherein the adjuster is on the back of the crown.

* * * * *